US005197156A

United States Patent [19]

Stryker et al.

[11] Patent Number: 5,197,156

[45] Date of Patent: Mar. 30, 1993

[54] TRANSFER BOARD SUPPORT LEVER AND SUPPORT POST

[75] Inventors: Martin W. Stryker, Kalamazoo Township, Kalamazoo County; Jeffry L. Lewandowski, Schoolcraft Township, Kalamazoo County, both of Mich.

[73] Assignee: Stryker Corporation, Kalamazoo, Mich.

[21] Appl. No.: 738,531

[22] Filed: Jul. 31, 1991

[51] Int. Cl.[5] ..... A61G 7/06

[52] U.S. Cl. ..... 5/428; 5/430; 5/185

[58] Field of Search ..... 5/81 B, 185, 424, 425, 5/427–430

[56] References Cited

U.S. PATENT DOCUMENTS

| | | | |
|---|---|---|---|
| 3,197,852 | 8/1965 | Johnson | 5/428 X |
| 3,220,024 | 11/1965 | Nelson | 5/429 |
| 3,344,445 | 10/1967 | Crawford . | |
| 3,840,917 | 10/1974 | Taylor | 5/430 |
| 4,839,933 | 6/1989 | Plewright et al. . | |
| 4,873,732 | 10/1989 | Perez . | |
| 4,987,623 | 1/1991 | Stryker et al. . | |

FOREIGN PATENT DOCUMENTS 2068850 8/1981 United Kingdom .

*Primary Examiner*—Michael F. Trettel

*Attorney, Agent, or Firm*—Flynn, Thiel, Boutell & Tanis

[57] ABSTRACT

A hospital bed has a transfer board which can be moved between a retracted position and an operational position. In the operational position, the board extends outwardly from an edge portion of the bed mattress and has an upwardly facing surface level with the top surface of the mattress. A board support mechanism includes a support lever pivotally supported on the bed for 180° movement from a retracted position through a support position to a further retracted position. In the support position, an outer upper end of the support lever engages the underside of an outer edge portion of the support member in order to firmly support the outer edge portion. As the support member moves between its retracted and operational positions, it moves through a further position in which it is oriented vertically adjacent an edge of the mattress, and a holding arrangement is provided to releasably maintain the support member in this position in order to facilitate fluoroscopy procedures and to confine a patient's limbs to the bed.

27 Claims, 4 Drawing Sheets

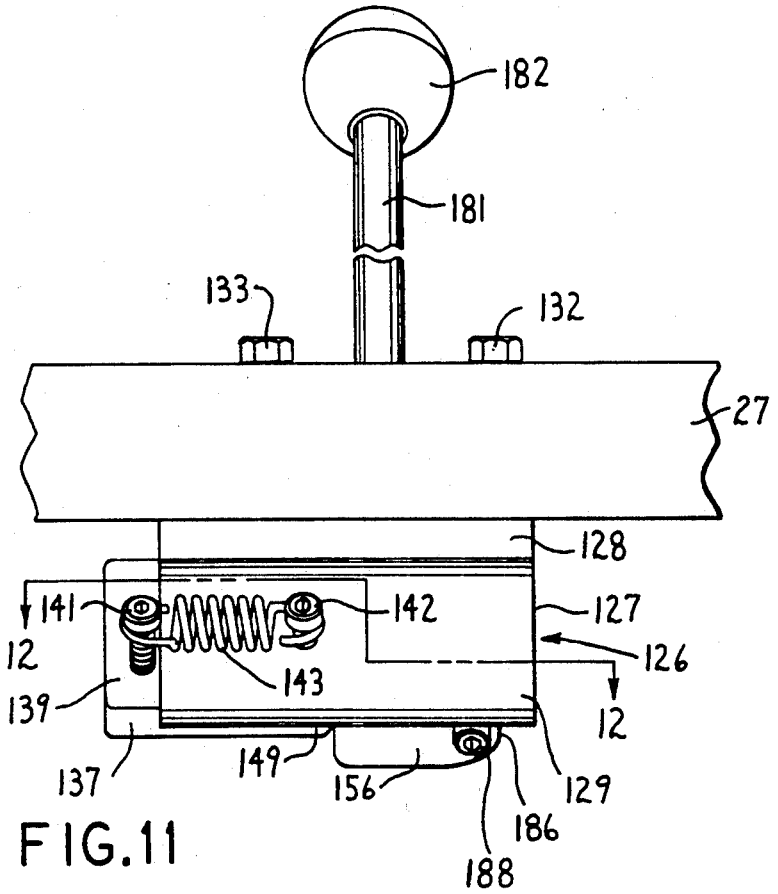
FIG.11
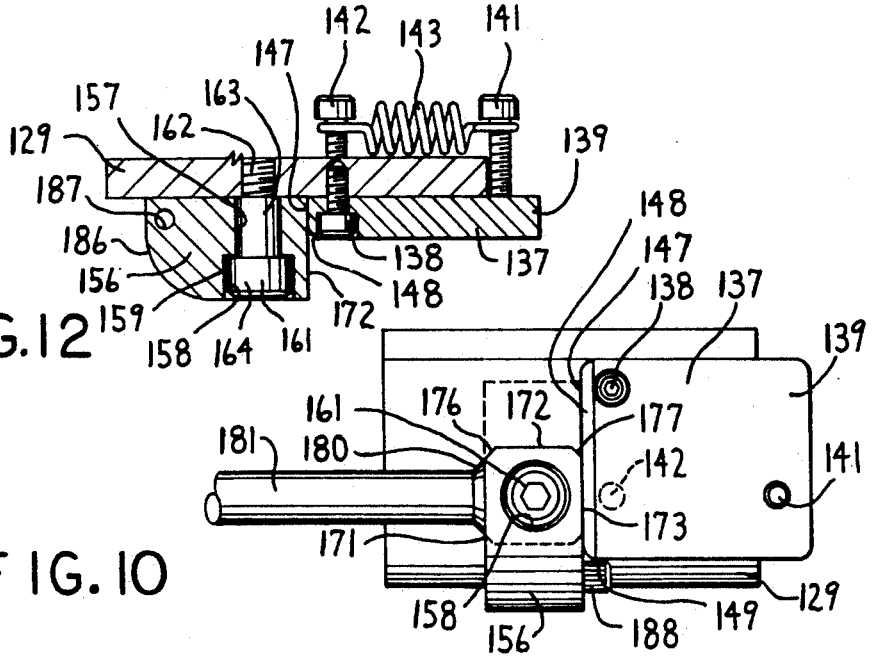
FIG.12
FIG.10

TRANSFER BOARD SUPPORT LEVER AND SUPPORT POST

FIELD OF THE INVENTION

This invention relates to a bed having a transfer board movable between a retracted position and an operational position in which it facilitates bed-to-bed patient transfers and, more particularly, relates to the provision in such a bed of a selectively actuable support arrangement which can support an outer end of the transfer board for purposes other than patient transfer and the provision of a holding arrangement to maintain the transfer board in a position facilitating fluoroscopy procedures.

BACKGROUND OF THE INVENTION

A conventional hospital bed disclosed in U.S. Pat. No. 4 987 623 has a transfer board which can be moved between a retracted position disposed lower than a patient support surface on the bed and an operational position in which it is disposed in the region of an edge portion of the patient support surface and is oriented so that a support surface thereon is facing upwardly and is at approximately the same level as the patient support surface. When the bed is placed adjacent another bed, an outer edge of the transfer board can be placed on the mattress of the other bed and thus provide a surface across which a patient can be conveniently slid in order to effect a bed-to-bed transfer of the patient. This known transfer board mechanism has proved entirely satisfactory for its intended purpose of effecting bed-to-bed patient transfers. However, it has not been entirely satisfactory with regard to certain other hospital procedures.

First, when the transfer board is being used for patient transfers, the outer edge of the board is supported by the mattress of an adjacent bed. However, the transfer board has also been found useful for purposes other than patient transfers. For example, when the bed having the transfer board is not adjacent another bed, the transfer board can still be useful in its operational position for purposes such as supporting a patient's arm while a wound in the arm is sutured. However, because the outer edge of the transfer board is not supported, it has been found that there is some tendency for the outer edge portion of the transfer board to flex downwardly in response to downward forces applied to it during suturing or other procedures. Obviously, this makes it difficult to quickly and neatly perform a procedure such as suturing. It is not possible to provide a fixed stationary support for the outer edge of the transfer board, because it would be a hazardous outward projection when the transfer board is in its retracted position and because it would prevent two beds from being positioned closely adjacent each other in order to use the transfer board for its primary purpose of a bed-to-bed patient transfer.

Moreover, conventional fluoroscopy procedures utilize equipment having a first portion which is laterally inserted into the region beneath the litter supporting the patient and a second portion which is laterally moved to a position above the patient on the litter. As to the known transfer board mechanism disclosed in above-mentioned U.S. Pat. No. 4 987 623, when the transfer board is in its retracted position the transfer board and its support mechanism are positioned to one side of and lower than the patient litter, and tend to obstruct the lateral insertion of conventional fluoroscopy equipment beneath the patient litter. Although it is not impossible to perform fluoroscopy procedures, it is definitely inconvenient.

It is therefore an object of the invention to provide a support arrangement which can be selectively used to support an outer edge portion of a transfer board when the board is being used in its operational position for purposes other than bed-to-bed patient transfers.

A further object of the invention is to provide such a support arrangement which can move to a retracted position when physically bumped in order to prevent injury or damage to persons or equipment.

It is a further object to provide a holding arrangement which can be selectively actuated to maintain a transfer board in a position which permits fluoroscopy procedures to be easily and quickly performed without interference from the transfer board or its support mechanism.

A further object is to provide such a support arrangement and holding arrangement which are each relatively simple and inexpensive in design, but which have long useful lifetimes with little or no need for maintenance.

A further object is to provide such a support arrangement and holding arrangement which are substantially self-contained and do not require redesign of the basic transfer board mechanism, so that both the support arrangement and holding arrangement can be retrofit to existing beds which have transfer boards.

SUMMARY OF THE INVENTION

The objects and purposes of the invention, including those set forth above, are met according to one form of the present invention by providing an apparatus which includes a bed having an upwardly facing surface, a support member having thereon a support surface, and a support arrangement supporting the support member on the bed for movement between a retracted position in which the support member is disposed below the surface on the bed and an operational position in which the support member is disposed in the region of an edge portion of the surface on the bed and is oriented so that the support surface thereon is facing upwardly and is at approximately the same vertical level as the support surface on the bed. The support surface on the support member has a portion which is disposed horizontally outwardly beyond the edge portion of the surface on the bed when the support member is in its operational position, and as the support member moves from its retracted position to its operational position the support arrangement causes the support member to move upwardly adjacent the edge portion of the surface on the bed with the support member oriented so that the support surface thereon extends approximately vertically. Also, as the support member moves from its retracted position to its operational position, it moves through a further position, and a selectively actuable holding arrangement is provided and, when actuated, holds the support member in its further position.

Another form of the invention involves the provision of an apparatus including a bed having a patient support section which has a portion of an underside thereof disposed immediately above an open region and has on an upper side thereof an upwardly facing support surface, a support member having thereon a support surface, and a support arrangement supporting the support member on the bed for movement upwardly along a path of travel from a retracted position to a further position. In the retracted position, the support member is disposed below the surface on the bed and the support arrangement has a lowermost portion which is substantially vertically lower than the portion of the underside of the patient support section. When the support member is in its further position, the support arrangement has a lowermost portion which is vertically in the region of the portion of the underside of the patient support section, and a selectively actuable holding arrangement is provided and, when actuated, holds the support member in its further position.

Yet another form of the invention involves the provision of an apparatus which includes a bed having an upwardly facing patient support surface, a member having a surface on one side thereof, and an arm having a first end pivotally supported on the bed and a second end pivotally coupled to the member, the arm supporting the member for generally vertical movement between a retracted position in which the member is disposed below the surface on the bed and a further position in which the member is vertically higher than in the retracted position and the surface on the member extends approximately vertically. A holding part is supported on the bed for movement between first and second positions respectively disposed in and spaced from a path of travel of the support arm, wherein in its first position the holding part engages the support arm and prevents pivotal movement of the support arm in a direction which would move the member away from its further position.

Another form of the invention involves the provision of an apparatus which includes a bed having an upwardly facing surface, a support member having thereon a support surface, and a support arrangement supporting the support member on the bed for movement between a retracted position and an operational position. In the operational position, the support member is disposed in the region of an edge portion of the surface on the bed and is oriented so that the support surface thereon is facing upwardly and is at approximately the same vertical level as the surface on the bed, the support surface including a portion which is disposed horizontally outwardly beyond the edge portion of the surface on the bed when the support member is in its operational position. A support part is supported on the bed for movement between a retracted position free of engagement with the support member and a support position in which a portion of the support part engages an underside of the support member at a location spaced horizontally outwardly from the edge portion of the surface on the bed.

BRIEF DESCRIPTION OF THE DRAWINGS

A preferred embodiment of the invention is described in detail hereinafter with reference to the accompanying drawings, in which:

FIG. 10 is a fragmentary view of a board supporting mechanism which is part of the bed of FIG. 1;

FIG. 11 is a rear view of the board supporting mechanism; and

FIG. 12 is a sectional view taken along the line 12—12 in FIG. 11.

DETAILED DESCRIPTION

Figure 1:
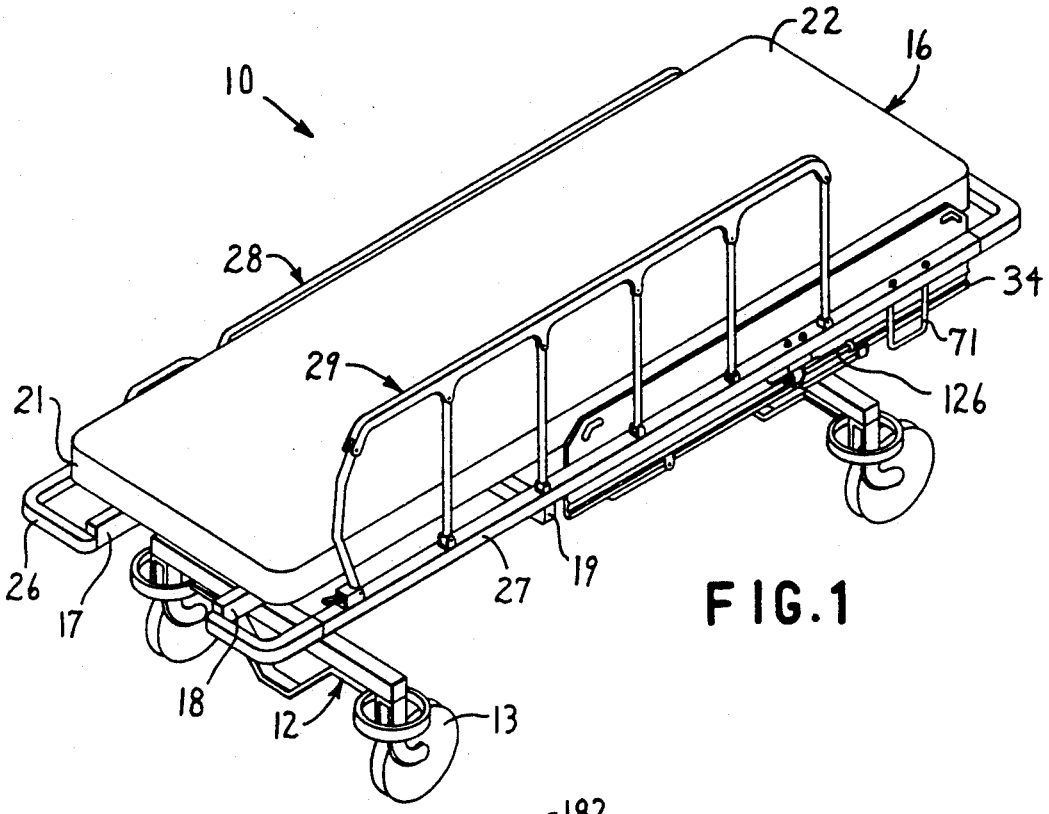
FIG. 1 is a perspective view of a hospital bed embodying the present invention.

FIG. 1 shows a bed 10 which is a hospital stretcher and embodies the present invention. Aside from the distinctive features of the invention, the bed 10 is very similar to the bed disclosed in U.S. Pat. No. 4 987 623 issued Jan. 29, 1991 to Martin W. Stryker and Thomas W. Fennell, the disclosure of which is hereby incorporated herein by reference.

The bed 10 includes a base 12 supported for movement by four casters 14. A patient support section 16 is supported on the base 12 at a location spaced above the base 12 by two vertical fluid-actuated cylinders which are not illustrated in the drawings but are conventional in all respects. The patient support section 16 includes a metal frame which supports a mattress 21, the frame including two parallel and spaced longitudinal spines 17 and 18, and a crossbar 19 which extends transversely to and engages the underside of each spine. The mattress 21 has an upwardly facing patient support surface 22.

A U-shaped side rail support 27 is supported on the crossbar 19 and has its ends fixedly connected to respective ends of the spine 18, and a similar U-shaped side rail support 26 is supported on crossbar 19 and has its ends fixedly connected to respective ends of the spine 17. Respective conventional collapsible side rails 28 and 29 are respectively supported on the side rail supports 26 and 27, each side rail being movable between raised position and a collapsed position. In FIG. 1, the side rail 28 is shown in the collapsed position, and the side rail 29 is shown in the raised position.

The bed 10 includes a transfer board mechanism 34, which is of the general type disclosed in above-mentioned prior U.S. Pat. No. 4 987 623, and which is briefly described here for purposes of completeness.

Figure 2:
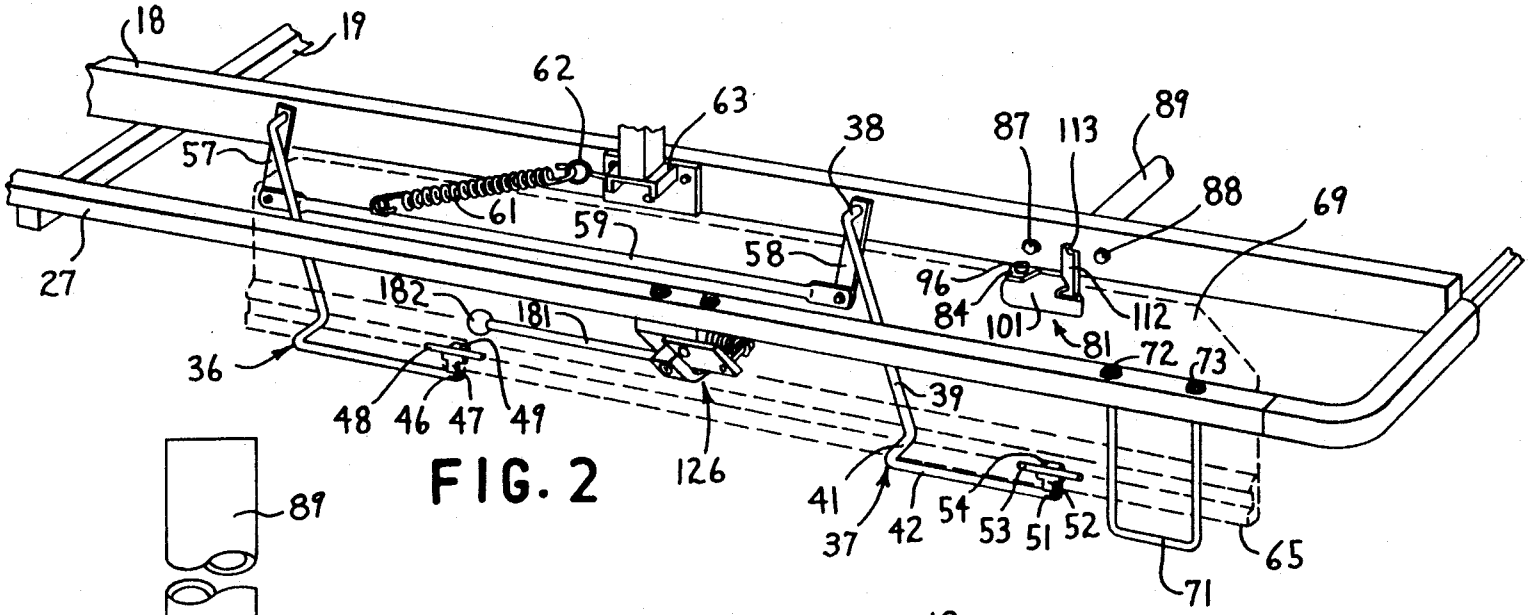
FIG. 2 is a perspective view of a transfer board mechanism which is part of the bed of FIG. 1.

Referring to FIG. 2, the transfer board mechanism 34 includes two support arms 36 and 37. The arm 37 includes a portion 38 which extends through an opening in and is pivotally supported by the spine 18, a portion 39 which extends radially outwardly from the outer end of portion 38, a portion 41 which extends outwardly from the opposite end of arm portion 39 substantially parallel to arm portion 38, and a portion 42 extending outwardly from the opposite end of arm portion 41 substantially normal to arm portion 41 and at an angle to arm portion 39. The arm 36 has an identical shape. The arm 36 is connected at its outer end by a pivot pin 46 to a fitting 47 which includes a cylindrical rod 48 and a stop 49, and in a similar manner the outer end of the arm 37 is connected by a pivot pin 51 to a fitting 52 which includes a cylindrical rod 53 and a stop 54, the cylindrical rods 48 and 53 being coaxial.

A linking plate 58 is fixedly secured to and extends radially outwardly from the portion 38 of arm 37, and a linking plate 57 is connected in a similar manner to the corresponding portion of arm 36. A link member 59 has its ends respectively pivotally coupled to the radially outer ends of the linking plates 57 and 58, and will thus cause the arms 36 and 37 to pivot synchronously. An expansion spring 61 has one end connected to the link member 59 and its opposite end connected to an eye bolt threadedly cooperating with a hole in a bracket 63 secured to the spine 18 of the frame. By turning the eye bolt 62, the eye moves longitudinally and thus permits the initial tension of the spring 61 to be adjusted. The spring 61 urges pivotal movement of both arms 36 and 37 in a direction which urges the fittings 47 and 52 thereon to move upwardly.

A transfer board 65 is supported on the cylindrical rods 48 and 53 of the fittings 47 and 52. FIG. 2 shows the transfer board 65 in a retracted position, in which a lowermost edge thereof engages the portions 42 of the arms 36 and 37 so as to prevent the arms 36 and 37 from rotating clockwise from the position shown in FIG. 2, and thus serving to define a lowermost position for the transfer board 65. In this retracted position, the transfer board 65 is, in its entirety, disposed lower than the upwardly facing patient support surface 22 on the mattress 21. In fact, in the position of FIG. 2, most of the structure of the transfer board and its support mechanism are vertically lower than the underside of the patient support section 16.

Figure 3:
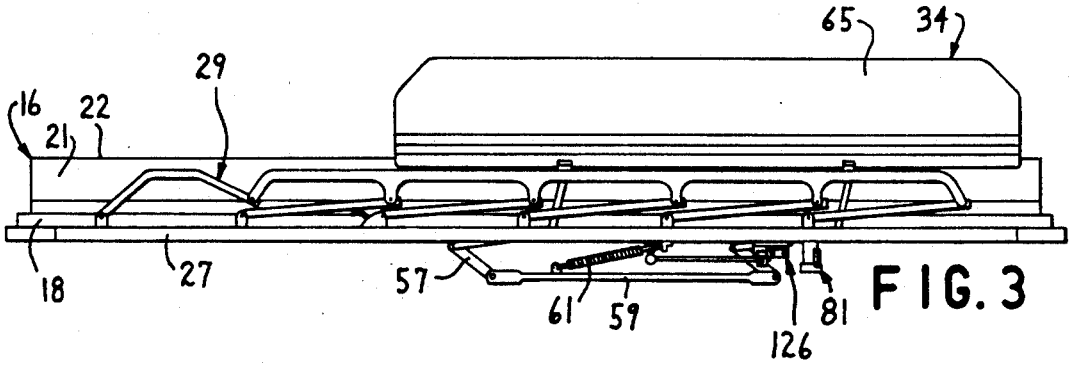
FIG. 3 is an elevational side view of a portion of the bed of FIG. 1 showing the transfer board in a raised position.

The transfer board 65 can be manually lifted from the retracted position shown in FIG. 2 to the position shown in FIG. 3, during which the arms 36 and 37 pivot clockwise in FIG. 2. In the position shown in FIG. 3, the stops 49 and 54 on the fittings 47 and 52 engage stop surfaces on the transfer board 65 to prevent it from pivoting toward and hitting a patient on the mattress. The board 10 can, however, be pivoted about the cylindrical rods 48 and 53 in the opposite direction to the position shown in FIG. 6, in which a support surface 67 thereon is oriented to face upwardly and in which an edge portion 68 of the board is disposed adjacent the mattress 22, the opposite edge portion 69 of the board 65 being spaced horizontally outwardly from the edge portion 68 in a direction away from the mattress 21, and the support surface 67 on the board 65 being approximately level with the patient support surface 22 on the mattress 21. The edge portion 68 engages the top of collapsed side rail 29, to provide support for the board 65.

As taught in above-mentioned prior U.S. Pat. No. 4 987 623, the outer edge portion 69 of the board can be placed on top of the mattress of a similar bed, so as to facilitate a patient transfer from one bed to the other by sliding the patient across the transfer board. It will be noted in FIG. 6 that the edge portion 69 of board 65 is inclined to extend downwardly and outwardly at a small angle with respect to the rest of the board, and thus the edge portion 69 will tend to be pressed down into the upper surface of the other mattress and will thus prevent the beds from inadvertently separating during the patient transfer.

When the transfer board 65 is in the retracted position shown in FIG. 2, the uppermost edge (edge portion 69) of the board 65 is slightly vertically lower than the U-shaped side rail support 27. Consequently, a U-shaped retainer in the form of a bent metal rod has the outer ends of its legs fixedly secured to the underside of side rail support 27 by two bolts 72 and 73 which extend through the side rail support 27, the retainer 71 projecting downwardly from the side rail support 27. In the event the board 65 attempts to pivot outwardly about the cylindrical rods 48 and 53 when the board is in its retracted position, the board will engage the retainer 71 and thus be prevented from tilting downwardly to a horizontal position.

When the transfer board 65 is in the position shown in FIG. 3, gravity urges it downwardly toward the retracted position shown in FIG. 2. The spring 61 is provided to partially counterbalance the force of gravity.

The portions of the bed 10 discussed above in this detailed description, including the transfer board mechanism 34, are basically conventional. Important features of the present invention will now be described.

Figure 8:
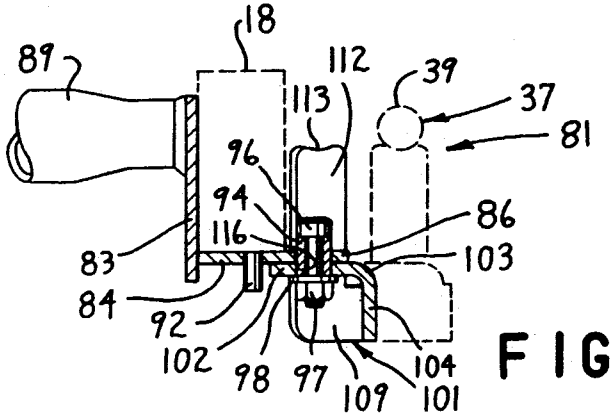
FIG. 8 is a sectional view taken along the line 8—8 in FIG. 7.
Figure 7:
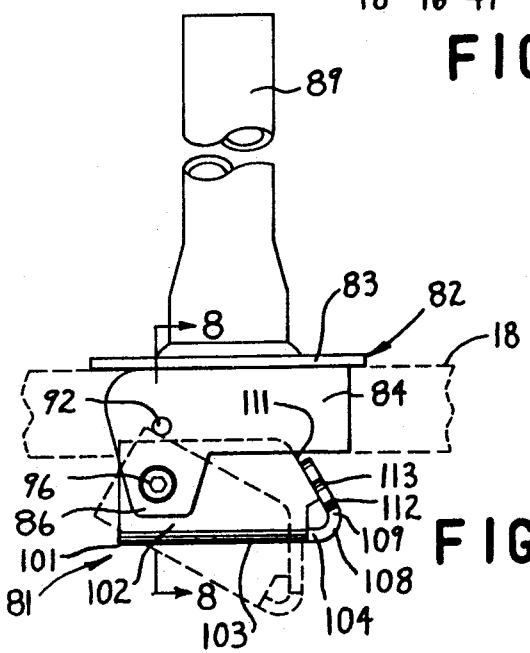
FIG. 7 is a top view of a holding mechanism which is part of the bed of FIG. 1.

Referring to FIGS. 2, 7 and 8, a board holding mechanism 81 includes an L-shaped bracket 82 made from two separate plates 83 and 84 welded to each other so as to form a right angle. Alternatively, the bracket 82 could be a single piece of metal bent to form a right angle. The plate 83 is disposed against an inner side surface of the spine 18, and the plate 84 is disposed against an underside of and supports the spine 18. The spine 18 is shown in broken lines in FIGS. 7 and 8 so that the board holding mechanism 81 can be seen more clearly. The spine 18 projects a small distance above the upper end of the plate 83, and the plate 84 has a portion 86 (FIGS. 7 and 8) which projects outwardly beyond the spine 18. The plate 83 is fixedly secured to the spine 18 by two bolts 87 and 88 (FIG. 2). A cross member 89 of the frame has one end welded to a side of the plate 83 opposite from the spine 18.

A cylindrical stop 92 is fixedly secured in a cylindrical hole provided in the plate 84 below the spine 18, and the stop 92 projects downwardly from the plate 94.

A cylindrical sleeve 94 extends through a circular hole in the outwardly projecting portion 86 of plate 84, and is fixedly secured to the plate 84, for example by welding the sleeve 94 to the upper side of plate 84. The sleeve 94 projects a small distance above and a small distance below the plate 94. A bolt 96 has a head disposed against the upper end of the sleeve 94 and has its shank extending completely through the sleeve 94, and a washer 98 having an outside diameter greater than the outside diameter of sleeve 94 is disposed against the lower end of sleeve 94 and is securely held in place by a nut 97 threadedly engaging the lower end of the shank of bolt 96.

A holding lever 101 is pivotally supported on the sleeve 94, and is made from a single piece of bent metal. In particular, the lever 101 has a horizontally extending planar portion 102 which is connected through a bend 103 to a further planar portion 104 which extends vertically downwardly from and approximately perpendicular to the planar portion 102, and the planar portion 104 is connected through a bent portion 108 to a further vertically extending planar portion 109 which is perpendicular to the planar portion 102 and extends at an angle to the planar portion 104, the planar portion 109 being disposed against an inclined edge 111 at the end of planar portion 102. The planar portion 109 includes an upright projection 112 which extends upwardly from a point adjacent the planar portion 102, and which has at its upper end a shallow concave groove or recess 113. The planar portion 102 has near an end remote from the inclined edge 111 and upright projection 112 a circular hole 116 with a diameter slightly greater than that of the cylindrical sleeve 94, the planar portion 102 being disposed between the washer 98 and projecting portion 86 of plate 84 with the sleeve 94 extending through the hole 116, the thickness of the planar portion 102 being slightly less than the distance between washer 98 and plate 84 so that there is little or no friction between the lever 101 and plate 84 and thus the lever 101 can be manually pivoted with minimal effort.

The pivotal movement of the lever 101 is between a retracted position shown in solid lines in FIGS. 7 and 8, and a holding position shown in broken lines in FIGS. 7 and 8. As the lever 101 is pivoted to the holding position, a portion of it engages the stop 92 in order to position the holding lever 101 in its holding position and prevent movement of the lever beyond its holding position.

Figure 4:
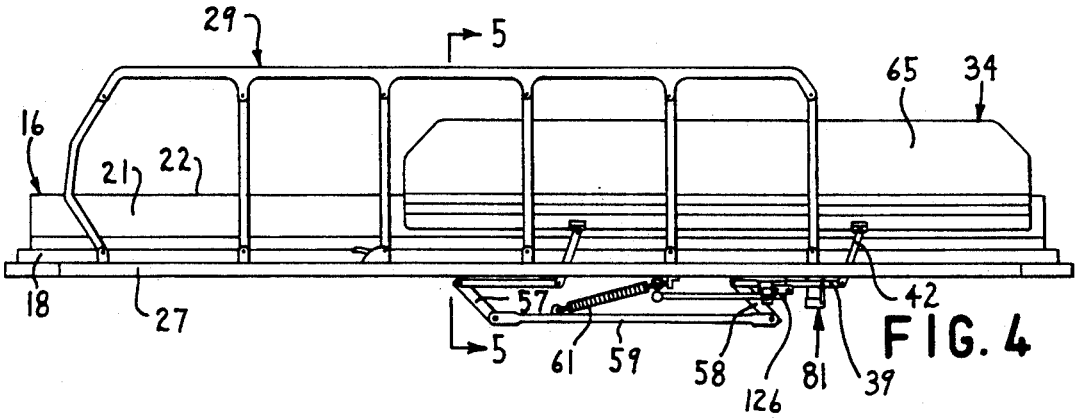
FIG. 4 is a view similar to FIG. 3 showing the transfer board in a different operational position.

When the lever is in its holding position, the portion 39 of the support arm 37 of the transfer board mechanism 34 can engage the concave recess 113 in the upright projection 112, as shown in FIGS. 8 and 4 and as discussed in more detail later. When the lever 101 is in its holding position shown in solid lines in FIGS. 7 and 8, the arm 37 of the transfer board mechanism 34 can move freely past the holding lever 101 without interference therewith.

Figure 9:
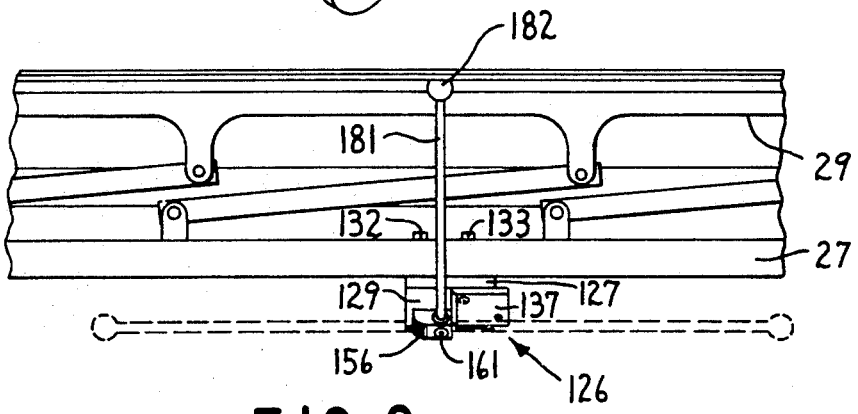
FIG. 9 is a fragmentary elevational side view of a portion of the bed of FIG. 1.
Figure 6:
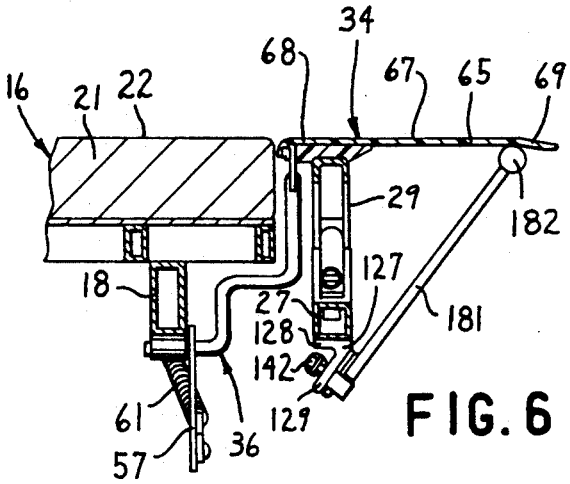
FIG. 6 is a sectional view similar to FIG. 5 but showing a side rail and the transfer board mechanism in different operational positions.

Referring to FIGS. 9 and 6, a board supporting mechanism 126 includes an angle bracket 127 having two legs 128 and 129 which extend at an acute angle to each other. The leg 128 is approximately rectangular and serves as a mounting plate which is disposed against the underside of the side rail support 27 and is fixedly secured thereto by two bolts 132 and 133 which have their heads disposed against the upper side of side rail support 27 and which each extend through side rail support 27 and engage a respective threaded hole provided in the mounting plate 128. The leg 129 is rectangular and serves as a support plate for the other components of the board supporting mechanism 126.

More specifically, and referring to FIGS. 10–12, a rectangular cam plate 137 is disposed against a front side of the support plate 129, and is pivotally supported by a pivot bolt 138 which extends through an opening near one corner of the cam plate 137 and engages a threaded hole provided in the support plate 129. The hole through plate 137 has a portion remote from the support plate 129 which is of larger diameter than the remainder of the hole, and which receives the head of bolt 138 so that the head does not project beyond the outer surface of plate 137, as shown in FIG. 12. An end portion 139 at the end of the plate 137 remote from the bolt 138 projects outwardly beyond the support plate 129. A spring support bolt 141 is secured in the end portion 139 of plate 137 and projects rearwardly therefrom beyond the support plate 129. A further spring support bolt 142 engages a threaded opening provided in the support plate 129 below the pivot bolt 138, and extends rearwardly from the support plate 129. A helical expansion spring 143 has each end supported on a respect of one of the bolts 141 and 142, and urges them toward each other, thereby urging the cam plate 137 to pivot clockwise in FIG. 10.

An edge 147 of the cam plate 137, which extends approximately radially with respect to the pivot bolt 138, serves as a cam follower surface. As best seen in FIGS. 10 and 12, a bevel 148 is provided between the cam follower surface 147 and the front surface of the cam plate 137. The lower edge surface of the cam plate 137 has a portion 149 which is adjacent the edge surface 147 and serves as a stop surface in a manner described later.

Referring to FIGS. 10 and 11, a cam member 156 is approximately rectangular and is thicker than the cam plate 137. The cam member 156 has therethrough an opening with portions 157 and 158 which are of different diameter and which have an annular step 159 between them. The cam member 156 is pivotally supported on the support plate 129 by a bolt 191 having a threaded portion at one end of its shank, a head 164 at the opposite end, and a cylindrical portion 163 which is located between the threaded portion 162 and the head 164 and which has a diameter greater than that of the threaded portion 162 and less than that of the head 164. The threaded portion 162 engages a threaded hole provided in the support plate 129. The axial length of the cylindrical portion 163 of bolt 161 has a diameter slightly less than the diameter of the portion 157 of the opening through cam member 156, and has an axial length slightly greater than the axial length of the opening portion 157, so that the cam member 156 can freely pivot on the bolt 161 with minimal radial and axial play, the head 164 of bolt 161 being received within opening portion 158.

The cam member 156 has thereon a cam surface defined by several surface portions 171, 172, 173, 176 and 177. The surface portions 172–173 are planar surfaces, the surface portions 171 and 173 being parallel and disposed on opposite sides of the cam member 156, and the planar surface portion 172 being perpendicular to the portions 171 and 173. The portion 176 is a bevel surface which extends between surface portions 171 and 172 at an angle of 45° with respect to each, and the surface 177 is a bevel surface which extends between surface portions 172 and 173 at an angle of 45° with respect to each. The bevel surfaces 176 and 177 could be replaced with cylindrical surface portions.

An elongate cylindrical metal support post 181 has one end welded at 180 (FIG. 10) to the surface 171 of the cam member 156, and has not-illustrated threads at its opposite end. A spherical support element 182 (FIG. 11) has a threaded opening extending radially into it, threadedly receives the outer end of support post 181. The cam member 156, support post 181 and spherical support element 182 together serve as a support lever which can be pivotally moved to a support position shown in solid lines in FIG. 9 and which can be pivoted 90 in either angular direction from this support position to either of two retracted positions shown in broken lines in FIG. 9. In the support position, as shown in FIG. 6, the spherical support element 182 engages the underside of the transfer board 65 when the transfer board 65 is in the operational position shown in FIG. 6. In particular, the spherical support element engages the transfer board 165 approximately at the point from which the outer edge portion 69 extends downwardly and outwardly at an incline to the rest of the transfer board 65. In each of the retracted positions shown in broken lines in FIG. 9, the support lever which includes post 181 and spherical element 182 is disposed substantially beneath and extends parallel to the side rail support 27. When in the retracted position in which it projects rightwardly in FIG. 9, the bevel 148 on cam plate 137 ensures that the weld 150 does not itself engage and pivot the cam member 156.

The portions 171, 172 and 173 serve as radial minimums of the cam surface whereas portions 176 and 177 serve as radial maximums. If the cam member 156 is rotated clockwise from the position shown in FIG. 10, the portion 177 of the cam surface will force the cam plate 137 to pivot counterclockwise a small angular amount against the urging of the spring 143, and then as the portion 172 of the cam surface moves into engagement with the cam follower surface 147, the cam plate 137 will be pivoted clockwise back to the original position shown in FIG. 10 by the spring 143. Thus, the cam plate 137 and spring 143 will tend to yieldably resist pivotal movement of the cam member 56 away from one of the three positions in which one of the cam surface portions 171, 172 and 173 is respectively engaging the cam follower surface 147 on cam plate 137, these three positions respectively corresponding to the support position and two retracted positions of the support lever shown in solid and broken lines in FIG. 9.

At an end of the cam member 156 remote from the surface portion 172, a rounded surface 186 is provided to minimize sharp edges on cam member 156, and also near that end is a transversely extending threaded hole 187 (FIG. 12) extending into the cam member 156. A bolt 188 has a shank threadedly engaged with the hole 187, and the head of bolt 188 serves as a stop member.

If the cam member 156 is pivoted 180° clockwise in FIG. 10 to the position shown in broken lines, the can surface portion 171 will be disposed against the cam follower surface 147 close to the pivot bolt 138, and further clockwise pivotal movement of the cam member 156 is impossible because the bolt 138 prevents rightward movement of the upper end of the cam plate 137 in response to forces exerted by cam surface portion 171 onto cam follower surface 147 closely adjacent bolt 138. On the other hand, when the cam member 156 is in the position shown in solid lines in FIG. 10, an attempt to rotate it in a counterclockwise direction causes surface 173 to exert rightward forces on the cam member 147 at a location spaced radially from the bolt 38. However, the head of bolt 188 serves as a stop member which engages the stop surface portion 149 on the cam plate 137 to prevent the cam member 156 from pivoting clockwise in FIG. 10.

On the side of the bed 10 opposite from the transfer board mechanism 34, board holding mechanism 81 and board supporting mechanism 126, there are a transfer board mechanism, a board holding mechanism and a board supporting mechanism which are identical to bent mirror images of the mechanisms 34, 81 and 126 respectively.

OPERATION

The transfer board 65 of the mechanism 34 is shown in its retracted position in FIG. 1. To move the transfer board 65 to its operational position, the transfer board 65 is manually lifted to the position shown in FIG. 3, which requires a minimum manual force because the spring 61 is counter-balancing much of the weight of the board 65. From the position of FIG. 3, the board itself is pivoted outwardly and downwardly to the position shown in FIG. 6, in which the inner edge portion 68 of the transfer board 65 rests on top of the side rail 29, which is in its collapsed position. If the bed 10 is adjacent a similar bed, then the outer edge portion 69 of the transfer board 65 can rest directly on the mattress of the adjacent bed in order to facilitate a patient transfer between the beds. Use of the transfer board in this manner is conventional, and is disclosed in above-mentioned prior U.S. Pat. No. 4 987 623.

According to the invention, when the bed 10 is not adjacent another bed, the transfer board 65 can still be used for certain purposes when in the operational position of FIG. 6, for example for supporting a patient's arm while a wound in the arm is sutured. In order to provide additional stability for the board 65 in such circumstances, the board supporting mechanism 126 is provided. In particular, when the board 65 is moved to the position of FIG. 6 for a reason other than transferring a patient between adjacent beds, the support lever which includes the cam member 156, post 181 and spherical member 182 is manually pivoted from either of the retracted positions shown in broken lines in FIG. 9 to the operational position shown in solid lines in FIGS. 9 and 6. In this position, the spherical element 182 engages the underside of the transfer board 65 at the point where the outer edge portion 69 begins its downward and outward incline. The support lever thus provides firm support for the righthand half of the transfer board 65 in FIG. 6, so that downward forces applied to it do not cause it to bend or flex downwardly, which would make procedures such as suturing difficult. When such a procedure is completed and the transfer board is returned to its retracted position, the support lever defined by elements 182, 181 and 156 is then manually pivoted from the support position shown in solid lines in FIG. 9 to either of the retracted positions shown in broken lines in FIG. 9. In the event hospital personnel inadvertently forget to return the lever to one of its retracted positions, a person walking by the stretcher and inadvertently bumping the lever will cause it to pivot to one of its two retracted positions, depending on the direction in which the person is walking. Similarly, if the bed were being moved and the support lever engaged a door frame or a piece of equipment, it would be pivoted from its support position to one of its retracted positions, depending on the direction of movement of the bed. The lever has been intentionally designed with two retracted positions specifically so that a force applied to it in either direction while it is in its support position will cause it to move to a retracted position without injury or damage to the person or thing which it contacted.

Figure 5:
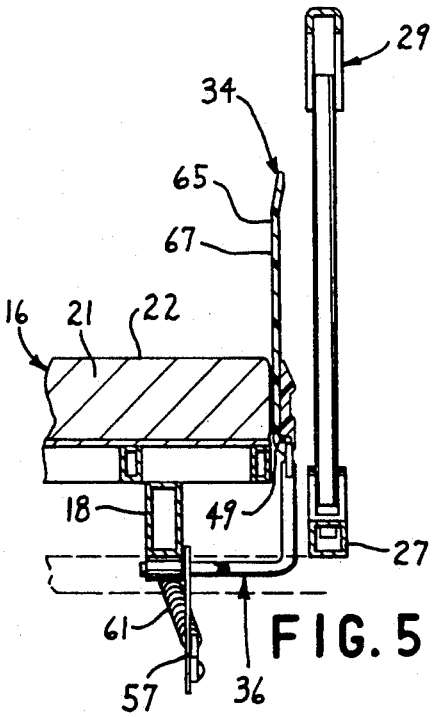
FIG. 5 is a sectional view taken along the line 5—5 in FIG. 4.

According to a further feature, while the transfer board 65 is in its operational position shown in FIG. 6, the holding lever 101 can be moved from the retracted position shown in solid lines in FIGS. 7 and 8 to the holding position shown in broken lines. Thereafter, the transfer board 65 can be pivoted upwardly from the position shown in FIG. 6 to the position shown in FIG. 3, and can then be lowered a small distance until the portion 39 of support arm 37 engages the concave recess 113 on the holding lever 101, as shown in FIG. 8. This prevents further downward movement of the transfer board, thereby maintaining the transfer board in the position shown in FIG. 4, in which it is slightly lower than in the fully raised position of FIG. 3. This position is also shown in FIG. 5. The primary reason for providing this position is to facilitate fluoroscopy procedures.

In particular, in a fluoroscopy procedure, respective portions of the fluoroscopy equipment must be moved laterally to positions just below the patient support section 16 and just over the patient on the support section 16. As evident from FIG. 2, when the transfer board 65 is in the retracted position, it is so low that it obstructs the transverse insertion of conventional fluoroscopy equipment beneath the patient support section 16. In contrast, when the board holding mechanism 81 is actuated in order to hold the transfer board 65 in the position of FIGS. 4 and 5, both the transfer board 65 and its support mechanism are maintained at vertical positions which permit conventional fluoroscopy equipment to be easily laterally inserted beneath the patient support section 16 and over the patient without interference.

The position of the transfer board shown in FIGS. 4 and 5 has a further advantage. In particular, when the side rails 28 and 29 are in their raised positions while the transfer board is fully retracted, the side rails are effective in preventing a patient from rolling off the bed. However, it is very commonplace for a patient's arm to slip out through one of the openings in the side rails, and if the bed is being moved and the arm contacts something such as a door frame or another bed, injury to the patient can result. However, when the transfer board 65 is in the position shown in FIGS. 4 and 5, it tends to prevent the patient's arms (and other portions of the patient's body) from moving to a position extending out through an opening in either side rail. The stop element 49 prevents the transfer board 65 from pivoting counterclockwise in FIG. 5 and thus hitting the patient, and when the side rail 29 is in the raised position shown in FIG. 5, the side rail 29 prevents the transfer board 65 from pivoting clockwise a significant amount. Thus, the transfer board 65 is confined substantially to the upright position shown in FIGS. 4 and 5.

To disengage the holding mechanism, the transfer board 65 is manually lifted a very small distance from the position shown in FIG. 4 back to the position shown in FIG. 3, and then the holding lever 101 is pivoted from the holding position shown in broken lines in FIGS. 7 and 8 back to the retracted position shown in solid lines in FIGS. 7 and 8. Then, the transfer board 65 is manually lowered back to the retracted position shown in FIG. 2, during which movement there is no engagement whatsoever between any portion of the board holding mechanism 126 and the holding lever 101.

Although a single preferred embodiment of the invention has been disclosed in detail for illustrative purposes, it will be recognized that there are variations or modifications of the disclosed embodiment, including the rearrangement of parts, which lie within the scope of the present invention.

The embodiments of the invention in which an exclusive property or privilege is claimed are defined as follows:

1. An apparatus comprising: a bed having an upwardly facing surface; a support member having thereon a support surface; support means supporting said support member on said bed for movement between a retracted position in which said support member is disposed below said surface on said bed and an operational position in which said support member is disposed in the region of an edge portion of said surface on said bed and is oriented so that said support surface thereon is facing upwardly and is at approximately the same vertical level as said surface on said bed, said support surface including a portion which is disposed horizontally outwardly beyond said edge portion of said surface on said bed when said support member is in said operational position, wherein as said support member moves from said retracted position to said operational position said support means causes said support member to move upwardly adjacent said edge portion of said surface on said bed with said support member oriented so that said support surface thereon extends approximately vertically, and wherein as said support member moves from said retracted position to said operational position said support member moves through a further position; and selectively actuable holding means for holding said support member in said further position when actuated, said holding means including a holding part supported on said bed for manual movement between first and second positions, wherein when said holding part is respectively in said first and second positions said holding means respectively permits and prevents movement of said support member from said further position toward said retracted position.

2. An apparatus of claim 1, wherein when said support member is in said further position a portion of said surface thereon extends vertically from a location spaced substantially vertically above said surface on said bed to a location adjacent said edge portion of said surface on said bed.

3. An apparatus of claim 1, wherein said support means includes a movable support part which is coupled to said support member and moves from a first position to a second position as said support member moves from said further position to said retracted position, wherein when said support part is in said first position said holding part is respectively spaced from and engaged with said support part when said holding part is respectively in said first and second positions thereof, engagement of said holding part with said support part preventing movement of said support part from said first position thereof toward said second position thereof.

4. An apparatus comprising: a bed having an upwardly facing surface; a support member having thereon a support surface; support means supporting said support member on said bed for movement between a retracted position in which said support member is disposed below said surface on said bed and an operational position in which said support member is disposed in the region of an edge portion of said surface on said bed and is oriented so that said support surface thereon is facing upwardly and is at approximately the same vertical level as said surface on said bed, said support surface including a portion which is disposed horizontally outwardly beyond said edge portion of said surface on said bed when said support member is in said operational position, wherein as said support member moves from said retracted position to said operational position said support means causes said support member to move upwardly adjacent said edge portion of said surface on said bed with said support member oriented so that said support surface thereon extends approximately vertically, and wherein as said support member moves from said retracted position to said operational position said support member moves through a further position; and selectively actuable holding means for holding said support member in said further position when actuated; wherein said support means includes first and second support arms each having a first end pivotally supported on said bed and a second end pivotally coupled to said support member; and wherein said holding means includes a holding part movable between positions disposed in and spaced from a path of movement of said first support arm, said holding part engaging said first support art when said support member is in said further position and preventing movement of said support arm along said path of movement thereof in a direction corresponding to movement of said support member to its retracted position.

5. An apparatus of claim 4, wherein said holding part is a pivotally supported holding lever.

6. An apparatus of claim 5, wherein said holding lever is supported on said bed for pivotal movement about a vertical axis, and has thereon an upwardly facing concave recess which receives a portion of said first support arm when said support member is in said further position.

7. An apparatus of claim 6, wherein said holding lever is made from a single piece of bent sheet metal, and includes a substantially planar horizontal portion coupled by a first bent portion to a substantially planar first vertical portion which in turn is coupled through a second bent portion to a substantially planar second vertical portion, said second vertical portion having a projection which projects upwardly past said horizontal portion and which has at an upper end thereof said concave recess.

8. An apparatus of claim 7, wherein said holding means includes a horizontally extending plate which is fixedly secured to said bed, a stop member projecting downwardly from said plate, a sleeve which extends through an opening in and is fixedly secured to said plate, and a bolt which extends through and has its head disposed against one end of said sleeve and which has thereon a nut engaging an opposite end of said sleeve, said horizontal portion of said holding lever having therethrough an opening which is of slightly greater diameter than and rotatably receives a portion of said sleeve disposed on one side of said plate, wherein as said holding lever is moved from said retracted position to said holding position said holding lever moves into engagement with said stop and said stop prevents pivotal movement of said holding lever past said holding position.

9. An apparatus comprising: a bed having an upwardly facing surface; a support member having thereon a support surface; support means supporting said support member on said bed for movement between a retracted position in which said support member is disposed below said surface on said bed and an operational position in which said support member is disposed in the region of an edge portion of said surface on said bed and is oriented so that said support surface thereon is facing upwardly and is at approximately the same vertical level as said surface on said bed, said support surface including a portion which is disposed horizontally outwardly beyond said edge portion of said surface on said bed when said support member is in said operational position, wherein as said support member moves from said retracted position to said operational position said support means causes said support member to move upwardly adjacent said edge portion of said surface on said bed with said support member oriented so that said support surface thereon extends approximately vertically, and wherein as said support member moves from said retracted position to said operational position said support member moves through a further position; and selectively actuable holding means for holding said support member in said further position when actuated; wherein said support means supports said support member for pivotal movement about a substantially horizontal axis; and including a side rail spaced outwardly from said edge portion of said surface on said bed and movable between a lowered position and a raised position, said upward movement of said support member with said support surface thereon approximately vertical taking place between said side rail and said edge portion of said surface on said bed, and wherein when said support member is in said further position and said side rail is in said raised position said side rail is adjacent said support member and prevents substantial pivotal movement of said support member away from said upright position about said horizontal axis.

10. An apparatus comprising: a bed having a patient support section which has a portion of an underside thereof disposed immediately above an open region and has on an upper side thereof an upwardly facing surface, a support member having thereon a support surface, and support means supporting said support member on said bed for movement upwardly along a path of travel from a retracted position to a further position, wherein in said retracted position said support member is disposed below said surface on said bed, wherein when said support member is in said retracted position said support means has a lowermost portion which is substantially vertically lower than said portion of said underside of said patient support section, and wherein said support member is in said further position said support means has a lowermost portion which is vertically in the region of said portion of said underside of said patient support section, and including selectively actuable holding means for holding said support member in said further position when actuated, said holding means including a holding part supported on said bed for manual movement between first and second positions, wherein when said holding part is respectively in said first and second positions said holding means respectively permits and prevents movement of said support member from said further position toward said retracted position.

11. An apparatus of claim 10, wherein said support means includes a movable support part which is coupled to said support member and moves from a first position to a second position as said support member moves from said further position to said retracted position, wherein when said support is in said first position said holding part is respectively spaced from and engaged with said support part when said holding part is respectively in said first and second positions thereof, engagement of said holding part with said support part preventing movement of said support part from said first position thereof toward said second position thereof.

12. An apparatus comprising: a bed having an upwardly facing patient support surface; a member having a surface on one side thereof; an arm having a first end pivotally supported on said bed and a second end pivotally coupled to said member, said arm supporting said member for generally vertical movement between a retracted position in which said member is disposed below said surface on said bed and a further position in which said member is vertically higher than in said retracted position and said surface on said member extends approximately vertically, and for movement between said further position and an operational position in which said surface on said member extends approximately horizontally, is at approximately the same vertical level as said patient support surface, and extends from an edge portion of said patient support surface to a location spaced horizontally outwardly from said edge portion; and a holding part supported on said bed for movement between first and second positions respectively disposed in and spaced from a path of travel of said support arm, wherein in said first position said holding part engages said support arm and prevents pivotal movement of said support arm in a direction which would move said member away from said further position toward said retracted position.

13. An apparatus of claim 12, wherein said holding part is supported on said bed for movement about a pivot axis between said first and second positions, and wherein said holding part is manually moved between said first and second positions.

14. An apparatus comprising: a bed having an upwardly facing surface; a support member having thereon a support surface; support means supporting said support member on said bed for movement between a retracted position and an operational position, wherein in said operational position said support member is disposed in a region of an edge portion of said surface on said bed and is oriented so that said support surface thereon is facing upwardly and is at approximately the same vertical level as said surface on said bed, said support surface including a portion which is disposed horizontally outwardly beyond said edge portion of said surface on said bed when said support member is in said operational position; and a support part supported on said bed for movement between a retracted position free of engagement with said support member and a support position in which a portion of said support part engages an underside of said support member at a location spaced horizontally outwardly from said edge portion of said surface on said bed; wherein said support part has a further retracted position in which it is free of engagement with said support member, said support part moving through said support position as said support part moves from one of said retracted positions to the other thereof.

15. An apparatus of claim 14, wherein said support part has a first end which is supported on said bed for pivotal movement about a pivot axis and has a second end, said portion engagable with said underside of said support member being provided at said second end of said support part.

16. An apparatus of claim 15, wherein said axis is inclined, and wherein said support part is elongate and extends approximately horizontally in said retracted position and extends upwardly at an incline in said support position.

17. An apparatus of claim 15, including means for yieldably resisting movement of said support part away from each of said retracted and support positions thereof.

18. An apparatus of claim 15, including means for yieldably resisting movement of said support part away from said support position and each of said retracted positions thereof.

19. An apparatus of claim 18, wherein said pivot axis of said support part is inclined, and wherein said support part is elongate and extends approximately horizontally in each of said retracted positions and extends upwardly at an incline in said support position.

20. An apparatus of claim 19, wherein said support part has thereon a cam surface, and wherein said means for yieldably resisting movement includes a cam follower supported for movement toward and away from the pivot axis of said support part and resiliently biased toward said pivot axis of said support part, said cam follower having a cam follower surface portion thereon which engages said cam surface on said support part.

21. An apparatus of claim 20, wherein said cam surface includes three radial minimum portions separated from each other by respective radial maximum portions, said three radial minimum portions respectively engaging said cam follower surface when said support part is respectively in said support position and said two retracted positions.

22. An apparatus of claim 20, including a stop surface on said cam follower,-and including a projecting stop on said support part, said stop moving into engagement with said stop surface as said support part pivots from said support position to one of said retracted positions, engagement of said stop and said stop surface preventing pivotal movement of said support part beyond the retracted position.

23. An apparatus according to claim 22, wherein said cam follower is supported for pivotal movement about an axis parallel to and spaced from said pivot axis of said support part, and wherein said means for yieldably resisting includes a spring which yieldably urges pivotal movement of said cam follower in a direction causing said cam follower surface thereon to be urged against said cam surface on said support part.

24. An apparatus of claim 22, wherein as said support part pivots from said retracted position in which said stop engages said stop surface through said support position to the other of said retracted positions, a portion of said cam surface on said support part moves into engagement with said cam follower at a location on said cam follower near said pivot axis of said cam follower.

25. An apparatus of claim 20, including a support plate fixedly supported on said bed, said support part and said cam follower each being pivotally supported on one side of said support plate, said cam follower having a portion projecting outwardly beyond an edge of said support plate, and said means for yieldably resisting including an expansion spring disposed on a side of said support plate remote from said support part and cam follower and having its ends respectively supported on said support plate and said projecting portion of said cam follower.

26. An apparatus of claim 25, including an angle bracket having first and second legs which extend at an angle to each other, said first leg being fixedly secured to said bed and said second leg being said support plate, and including first and second bolts which threadedly engage respective threaded holes provided in said support plate and said cam follower and which project rearwardly, each end of said spring being supported on a respective one of said bolts.

27. An apparatus of claim 26, wherein said support part includes a cam member which is pivotally supported on said support plate and has thereon said cam surface, an elongate cylindrical rod which has one end fixedly secured to said cam member and extends radially outwardly therefrom, and a spherical end member supported on an end of said rod remote from said cam member, said spherical end member being engagable with said support member when said support member is in said operational position and said support part is in said supporting position.

* * * * *

UNITED STATES PATENT AND TRADEMARK OFFICE

CERTIFICATE OF CORRECTION

PATENT NO. : 5 197 156

DATED : March 30, 1993

INVENTOR(S) : Martin STRYKER et al

It is certified that error appears in the above-identified patent and that said Letters Patent is hereby corrected as shown below:

Column 14, line 25; after "wherein" insert ---when---.

Signed and Sealed this

Fourth Day of January, 1994

Bruce Lehman

*Attest:*

BRUCE LEHMAN

*Attesting Officer*

*Commissioner of Patents and Trademarks*